US005699731A

United States Patent [19]

Hara

[11] Patent Number: 5,699,731

[45] Date of Patent: Dec. 23, 1997

[54] INK-SUPPLY CONTROL DEVICE AND STENCIL PRINTING MACHINE HAVING THE SAME

[75] Inventor: Yoshikazu Hara, Ibaraki, Japan

[73] Assignee: Riso Kagaku Corporation, Tokyo, Japan

[21] Appl. No.: 687,949

[22] Filed: Jul. 26, 1996

[30] Foreign Application Priority Data

Jul. 28, 1995 [JP] Japan ..... 7-193374

[51] Int. Cl.[6] ..... B41F 15/40

[52] U.S. Cl. ..... 101/119; 101/DIG. 45; 101/484

[58] Field of Search ..... 101/116, 119, 101/120, 123, 124, 129, 484, 491, DIG. 45, 366, 363, 350

[56] References Cited

U.S. PATENT DOCUMENTS

| | | | |
|---|---|---|---|
| 4,385,558 | 5/1983 | Takahashi et al. | 101/120 |
| 4,563,947 | 1/1986 | Matsushita et al. | 101/122 |
| 4,693,179 | 9/1987 | Watts | 101/119 |
| 5,460,091 | 10/1995 | Mazzenga et al. | 101/366 |
| 5,517,913 | 5/1996 | Oshio et al. | 101/119 |

FOREIGN PATENT DOCUMENTS 0 607 699 7/1994 European Pat. Off. .

*Primary Examiner*—Ren Yan

*Attorney, Agent, or Firm*—Sughrue, Mion, Zinn, Macpeak & Seas, PLLC

[57] ABSTRACT

In a stencil printing machine, when quantity of ink supplied into an ink supplying section in a rotary cylindrical drum is smaller than a predetermine value, ink complementing means is driven to supply ink from an ink storing container into the ink supplying section, and when the quantity of ink in the ink supplying section does not reach the predetermined value within an ink-complementing-means operation time, a determination is made that no ink is left in the ink storing container, and a warning signal is produced. The stencil printing machine comprises: a quantity-of-ink detector for detecting whether or not the quantity of ink in the ink supplying section has reached the predetermined value; a kind-of-ink detector for detecting the kind of ink supplied into the ink supplying section in the rotary cylindrical drum; and controller which operates to change, according to the kind of ink detected by the kind-of-ink detector, the ink-complementing-operation time which elapses until a determination is made that no ink is left in the ink storing container.

28 Claims, 13 Drawing Sheets

INK-SUPPLY CONTROL DEVICE AND STENCIL PRINTING MACHINE HAVING THE SAME

BACKGROUND OF THE INVENTION

This invention relates to stencil printing machines, and more particularly to a stencil printing machine in which plural kinds of printing inks such as printing inks different in color can be used.

A stencil printing machine is well known in the art which comprises: a rotary cylindrical drum including a cylinder on which a printing stencil is wound, and an ink supplying section inside the cylinder; and a press roller which is pressed against the printing stencil wound on the cylinder, and in which a printing sheet supplied from a sheet supply section is pressed against the rotary cylindrical drum, to perform a stencil printing operation.

A stencil printing machine is also well known in the art which comprises: a rotary cylindrical drum including a porous flexible cylindrical wall on which a printing stencil is wound, and an ink supplying section inside the flexible cylindrical wall of the drum; a back press roller which is set in such a manner that it is spaced a predetermined distance from the rotary cylindrical drum and is in parallel with the latter; and an inner press roller adapted to push the cylindrical wall radially outwardly to deform the latter towards the back press roller, and in which a stencil printing operation is carried out by supplying a printing sheet from the sheet supplying section into the space between the back press roller and the rotary cylindrical drum which is deformed by the inner press roller.

In each of the above-described conventional stencil printing machines, the ink supplying section generally comprises: a squeegee roller adapted to apply printing ink on the inner cylindrical surface of the rotary cylindrical drum; a doctor roller set near the squeegee roller; and an ink distributor for distributing the ink to an ink pool section formed by the squeegee roller and the doctor roller which is supplied from an ink storing container. In a printing operation, a quantity-of-ink detecting means detects the quantity of ink in the ink pool section. When it is determined that the quantity of ink is inadequate, ink supplying means such as an ink pump is operated to supply ink from the ink storing container through the ink distributor to the ink pool section.

The above-described quantity-of-ink detecting means is generally an electrostatic capacity type quantity-of-ink detecting device which is developed on the fact that the electrostatic capacity between the detecting electrode and an ink supply roller such as the squeegee roller and the doctor roller depends greatly on whether or not the end of a needle-like detecting electrode is in contact with the ink in the ink pool section (cf. Japanese Utility Model Publication No. Hei. 3-28342, and Japanese Patent Application Laid-open No. Sho. 61-198064).

The electrostatic capacity type quantity-of-ink detecting device has been developed by ingeniously utilizing the electrical characteristics of the ink in the ink pool section that it is high in resistance and high in dielectric constant. The device detects the shortage of ink in the ink pool section during a stencil printing operation from the fact that, when an ink vortex in the ink pool section becomes smaller in diameter than a predetermined value which the ink vortex is formed by the rotation of an ink supply roller such as the squeegee roller and the inside pusher roller, the detecting electrode is not in contact with the ink pool section, and the electrostatic capacity is therefore changed.

When no ink is left in the ink storing container, it is detected as follows: That is, in the case when the ink in the ink pool section is short in quantity as was described above, and, although ink complementing means is driven for a certain period of time in response to the ink shortage detection signal, the quantity of ink in the ink pool section does not reach a predetermined value, a "no-ink" detection signal is outputted. In this connection, the period of time which elapses until the "no-ink" detection signal is outputted is so determined that it is long to the extent that it can be determined that the ink in the ink storing container is completely used up, and is short to the extent that the ink remaining in the ink pool section is enough to accomplish the printing operation (hereinafter referred to as "ink-complementing-means operation time", when applicable) without no bad effect on the print.

A quantity-of-ink detecting device disclosed, for instance, by Japanese Patent Application Laid-open No. Sho. 61-198064 is designed as follows: A fixed count value corresponding to the aforementioned time is set in a counter. When the detecting electrode becomes not in contact with the ink pool section, the ink shortage detection signal is provided. And the counter counts clock signals outputted by a clock signal generating circuit until the detection signal is provided in the above-described manner. When the count value reaches the predetermined value set in the counter, it is determined that no ink is left in the ink storing container, so that a pump stopping instruction signal is applied to an ink pumping circuit. In response to the signal, the motor is stopped; that is, the supplying of ink to the ink pool section is suspended. The counter is reset by a signal which is provided when the detecting electrode is brought into contact with the ink pool section before the count value reaches the predetermined value.

When it is required to provide a multi-color print by using the above-described stencil printing machine, it is necessary to prepare as many rotary cylindrical drums as the number of different colors to be used. That is, a color printing operation is carried out with the rotary cylindrical drum replaced for every color; that is, different rotary cylindrical drums are used for different colors. For instance, in the case of a print colored with black, red and blue inks, three rotary cylindrical drums are prepared for those three colors, respectively, and they are loaded in the machine body one after another.

In general, different inks are of different pigments, and are different in particle size, and accordingly in viscosity. Even in the case where a plurality of inks are the same color, they are different in ink viscosity if they are different in the composition of pigment, resin, solvent, surface active agent, water, etc. and in the properties of them, and in the content ratio of them. In the case where a plurality of printing inks different in ink viscosity are employed, and the ink supply roller or the doctor roller is of an elastic material such as rubber, the quantity of ink changes which is supplied to the inner cylindrical surface of the rotary cylindrical drum through the gap between the ink supply roller and the doctor roller. Hence, in the case where printing operations are carried out with the inks different in ink viscosity, those printing operations are different in the consumption of ink per unitary time.

However, conventionally, the ink complementing means operation time (the counter value set in the counter) for determining the timing of outputting the "no-ink" detection signal is predetermined irrespective of the kind of ink. Hence, the "no ink" period of time which elapses from the time instant that the quantity-of-ink detecting means outputs the ink shortage detection signal when the ink in the ink storing container is completely used up until the "no ink" detection signal is outputted, is constant for all kinds of printing inks. Therefore, in the case where an ink great in consumption is employed, the ink in the ink pool section is used up before the "no ink" detection signal is outputted, so that the resultant print appears blurred.

In the printing operation, the ink supply roller is rotated, and therefore a vortex fluid current is formed in the ink in the ink pool section, and it is extended vertically. Hence, in order to obtain a print which is even (not being blurred), it is preferable to increase the diameter of the ink vortex to some extent. However, the rotation of the ink supply roller is suspended upon completion of the printing operation, the vertically extending ink vortex is liable to collapse because of its own weight. Hence, in the case where an ink relatively low in viscosity is used, and the ink vortex is made large in diameter, the ink is caused to flow over the part of the outer cylindrical surface of the ink supply roller which is on the lag side as viewed in the direction of rotation of the latter, thus dripping onto the inner cylindrical surface of the rotary cylindrical drum. When the ink thus dripped (on the inner cylindrical surface of the rotary cylindrical drum) is moved to the uppermost point of the rotary cylindrical drum as the latter turns during the printing operation, the ink is dropped by its own weight, thus staining the inside of the rotary cylindrical drum, and sticking onto an electrical circuit board forming the quantity-of-ink detecting means, and the drive mechanism, to adversely affect the operations of those elements.

The above-described problem may be solved by decreasing the diameter of the ink vortex formed during the printing operation. However, the method gives rise to another problem. That is, in this case, the quantity of ink in the ink pool section is decreased, and therefore there is a risk that the ink in the ink pool section is used up before the ink-complementing-means operation time passes, as a result of which the resultant print appears unsatisfactory in picture quality as was described above.

SUMMARY OF THE INVENTION

In view of the foregoing, an object of the invention is to provide a stencil printing machine in which the ink-complementing-means operation time can be set to a best value according to the kind of ink to be used, and which is free from the difficulties that, depending on the kind of ink, the ink in the ink pool section is used up before the lapse of the ink-complementing-means operation time, and the resultant print appears blurred.

To achieve the objects, the present invention is to provide a stencil printing machine in which, when the quantity of ink supplied into an ink supplying section in a rotary cylindrical drum is smaller than a predetermine value, ink complementing means and is driven to supply ink from an ink storing container into the ink supplying section, and when the quantity of ink in the ink supplying section does not reach the predetermined value within a ink-complementing-means operation time, a determination is made that no ink is left in the ink storing container, and a warning signal is produced, the stencil printing machine comprising:

quantity-of-ink detecting means for detecting whether or not the quantity of ink in the ink supplying section has reached the predetermined value;

kind-of-ink detecting means for detecting the kind of ink supplied into the ink supplying section in the rotary cylindrical drum; and control means which operates to change, according to the kind of ink detected by the kind-of-ink detecting means, the ink- complementing-means operation time which elapses until a determination is made that no ink is left in the ink storing container.

In the stencil printing machine, the kind-of-ink detecting means may be so designed as to detect the kind of ink from data on ink color, or from data on ink viscosity.

In the stencil printing machine mentioned above, the quantity-of-ink detecting means may comprise memory means in which data on an integration time is stored for which the ink complementing means is continuously driven according to a signal representing that the quantity of ink supplied into the ink supplying section is smaller than the predetermined value.

The control means may be so designed as to operate to stop the driving of the ink complementing means when the integration time stored in the memory means exceeds the ink-complementing-means operation time.

In the stencil printing machine mentioned above, the ink storing container is replaceably loaded in a machine body, and has ink data indicating the kind of ink contained therein, and the kind-of-ink detecting means may be so designed as to detect the kind of ink supplied into the ink supplying section in the rotary cylindrical drum according to the ink data. The ink data may be optical data such as bar codes, slits, reflecting piece, and character identifying data, and the kind-of-ink detecting means may be an optical sensor adapted to read the optical data. In this case, the kind-of-ink detecting means may be the combination of a magnetic piece in which the ink data are magnetically recorded, and a magnetic sensor adapted to read the ink data of the magnetic piece, or the combination of a protrusion (or rib) or recess formed in the ink storing container, and a switch adapted to detect the configuration of the protrusion or recess.

Furthermore, in the stencil printing machine mentioned above, the rotary cylindrical drum is replaceably loaded in a machine body, the rotary cylindrical drum having ink data indicating the kind of ink, and the kind-of-ink detecting means detects from the ink data the kind of ink supplied into the ink supplying section in the rotary cylindrical drum. The rotary cylindrical drum may have data giving means for giving the ink data thereto. In this case, the data giving means may comprise a plurality of dip switches or rotary switch.

Furthermore, the ink data may be optical data such as bar codes, slits, reflecting piece, and character identifying data, and the kind-of-ink detecting means may be an optical sensor adapted to read the optical data. In this case, the optical sensor may be made up of a magnetic piece in which the ink data are magnetically recorded, and a magnetic sensor adapted to read the ink data of the magnetic piece.

In the stencil printing machine mentioned above, the ink supplying section may comprises:

a squeegee roller for applying ink to the inner cylindrical surface of the rotary cylindrical drum;

a doctor roller arranged adjacent to the squeegee roller;

an ink distributor for distributing the ink which is supplied from the ink storing container to an ink pool section which is formed by the squeegee roller and the doctor roller.

The quantity-of-ink detecting means has a detecting electrode which contacts or leaves the ink in the ink pool section depending on the quantity of ink in the ink pool section, the quantity-of-ink detecting means detecting the quantity of ink from variations in the electrostatic capacity between the detecting electrode and the combination of the squeegee roller and doctor roller which are due to whether or not the detecting electrode is in contact with the ink in the ink pool section.

With the stencil printing machine designed as described above, when the kind of ink to be used, for instance the color of the ink, is detected by the kind-of-ink detecting means, the ink-complementing-means operation time TB is determined according to the result of detection.

DETAILED DESCRIPTION OF THE PREFERRED EMBODIMENTS

Figure 1:
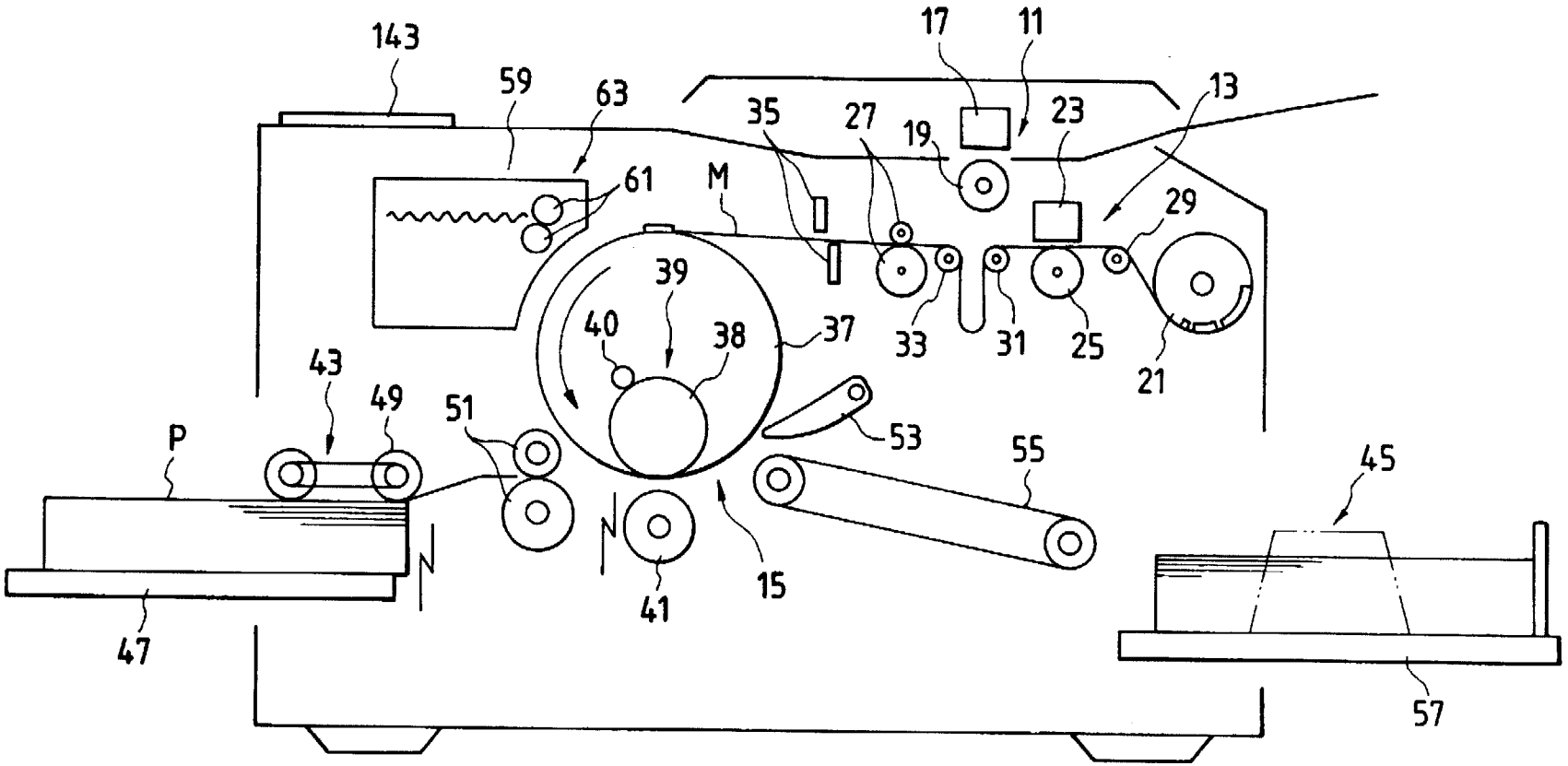
FIG. 1 is an explanatory diagram showing the whole arrangement of an example of a stencil printing machine having a printing-stencil making function according to the present invention.

FIG. 1 is a diagram showing the whole arrangement of an example of a stencil printing machine having a printing-stencil making function to which the technical concept of the invention is applied. Roughly stated, the stencil printing machine has an original reading section 11, a printing-stencil making section 13, and a printing section 15.

The original reading section 11 comprises: a line image sensor 17 which is an image scanner for reading the image of an original which is moved in an auxiliary scanning direction; and an original conveying roller 19.

The printing-stencil making section 13 comprises: a stencil roll section 21; a thermal head 23 having a plurality of dot-like heat generating elements arranged in a line; stencil conveying rollers 25 and 27; stencil guide rollers 29, 31 and 33; and a stencil cutter 35. The printing-stencil making section 13 operates as follows: In the thermal head 23, the dot-like heat generating elements individually and selectively generate heat to form holes in a matrix form in a heat-sensitive stencil M according to the image of the original; i.e., to form a printing stencil according the image of the original. Thereafter, the stencil M thus treated is cut with the stencil cutter 35.

The printing section 15 comprises: a porous rotary cylindrical drum 37 which is made of an porous material such as a porous metal plate and a mesh structure so that ink passes through the drum 37; an ink supplying device 39 including a squeegee roller 38 and a doctor roller 40; and a press roller 41. The printing stencil, which is made by processing the stencil M with the thermal head and by cutting it with the cutter 35, is wound on the outer cylindrical surface of the drum 37.

A sheet supplying section 43 is provided on one side of the printing section 15, and a sheet discharging section 45 is provided on the other side.

The sheet supplying section 43 comprises: a sheet supplying table 47 on which printing sheets P are stacked; pick-up rollers 49 for taking the printing sheets P from the sheet supplying table 47 one at a time; and timing rollers 51 for sending a printing sheet P into the space between the drum 37 and the press roller 41.

The sheet discharging section 45 comprises: a sheet separator claw 53 for removing the printed sheet P from the drum 37; a sheet conveying belt section 55; and a sheet discharging tray 57 on which printed sheets P are stacked.

On the one side of the printing section 15, a stencil removing section 63 is provided which includes stencil removing rollers 61 adapted to remove the used printing stencil from the drum 37 and to convey it into a stencil disposal box 59.

In the above-described stencil printing machine, the ink supplying device 39 supplies an ink having a predetermined color to the inside of the drum 37. The drum 37 is turned counterclockwise (in FIG. 1) around its central axis by rotating means (not shown). In synchronization with the rotation of the drum 37, a printing sheet P is supplied into the space between the drum 37 and the press roller 41 with the predetermined timing while being conveyed in a left-to-right direction in FIG. 1. The printing sheet P thus supplied is pressed against the printing stencil M wound on the outer cylindrical surface of the rotary cylindrical drum 37, so that a print is formed with the aforementioned ink.

First Example of the Replaceable drum

Figure 2:
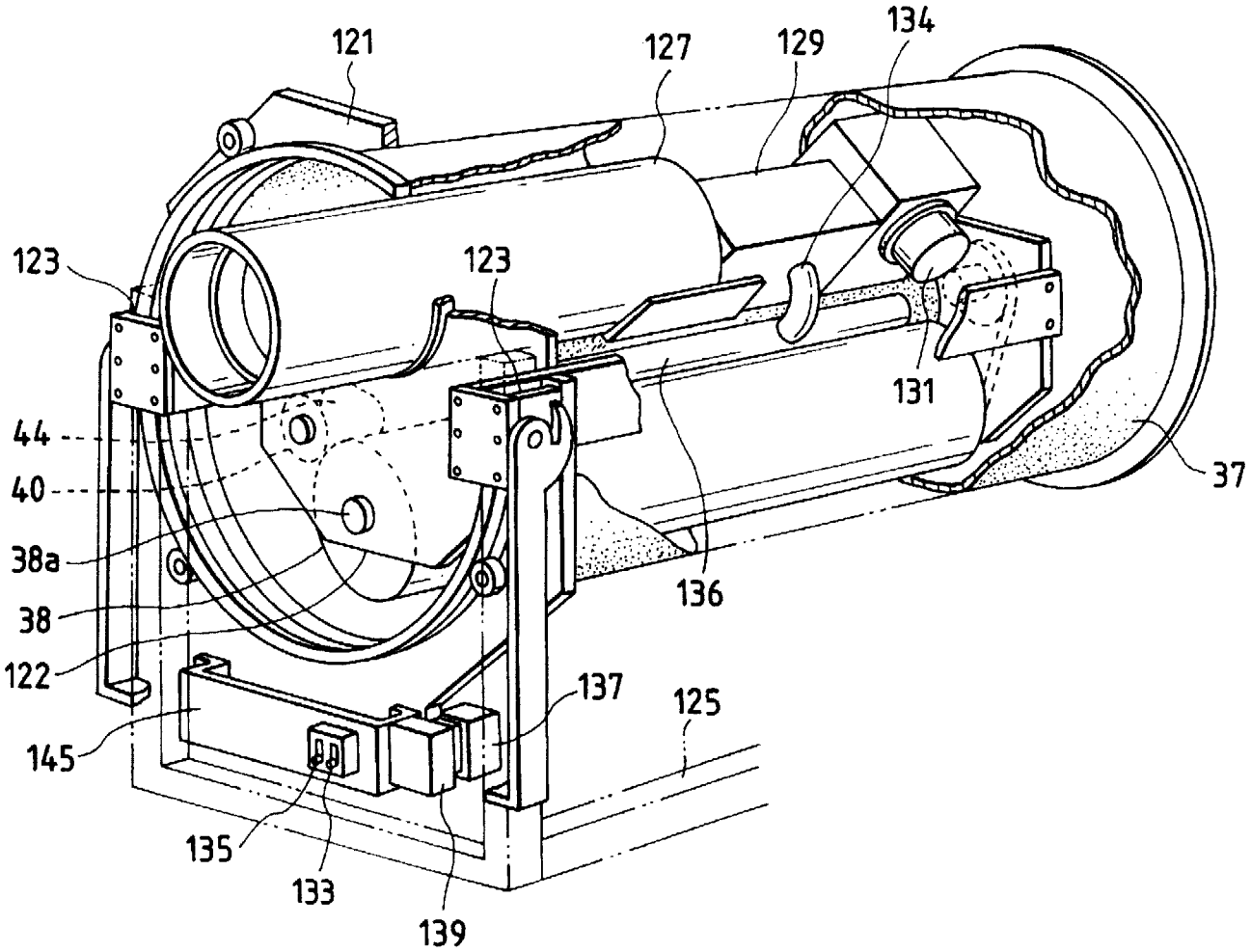
FIG. 2 is a perspective view showing a first example of a replaceable rotary cylindrical drum in the stencil printing machine according to the invention.

FIG. 2 is a perspective view showing a first example of a replaceable rotary cylindrical drum employed in the above-described stencil printing machine.

The replaceable rotary cylindrical drum 37 (hereinafter referred to merely as "a drum 37", when applicable), as shown in FIG. 2, is one unit which is rotatably supported on a supporting board 121. The drum 37 is detachably engaged with a drum supporting frame 125 with the aid of engaging sections 123 provided on the supporting board 121. The drum supporting frame 125 is movable; that is, it can be freely pushed into and pulled out of the stencil printing machine body (hereinafter referred to merely as "a machine body", when applicable), so that the drum may be replaced with another one.

Inside the drum 37, a supporting frame 122 secured to the supporting board 121 is provided. The squeegee roller 38 is mounted on the supporting frame 122 in such a manner that it is in parallel with the generating line of the drum 37. More specifically, the squeegee roller 38 has supporting shafts on its both ends through which the squeegee roller 38 is rotatably supported on the supporting frame 122. In a printing operation, part of the outer cylindrical surface of the squeegee roller 38 is brought into contact with the inner cylindrical surface of the drum 37, thus being turned counterclockwise in FIG. 2 in synchronization with the rotation of the drum 37.

Figure 3:
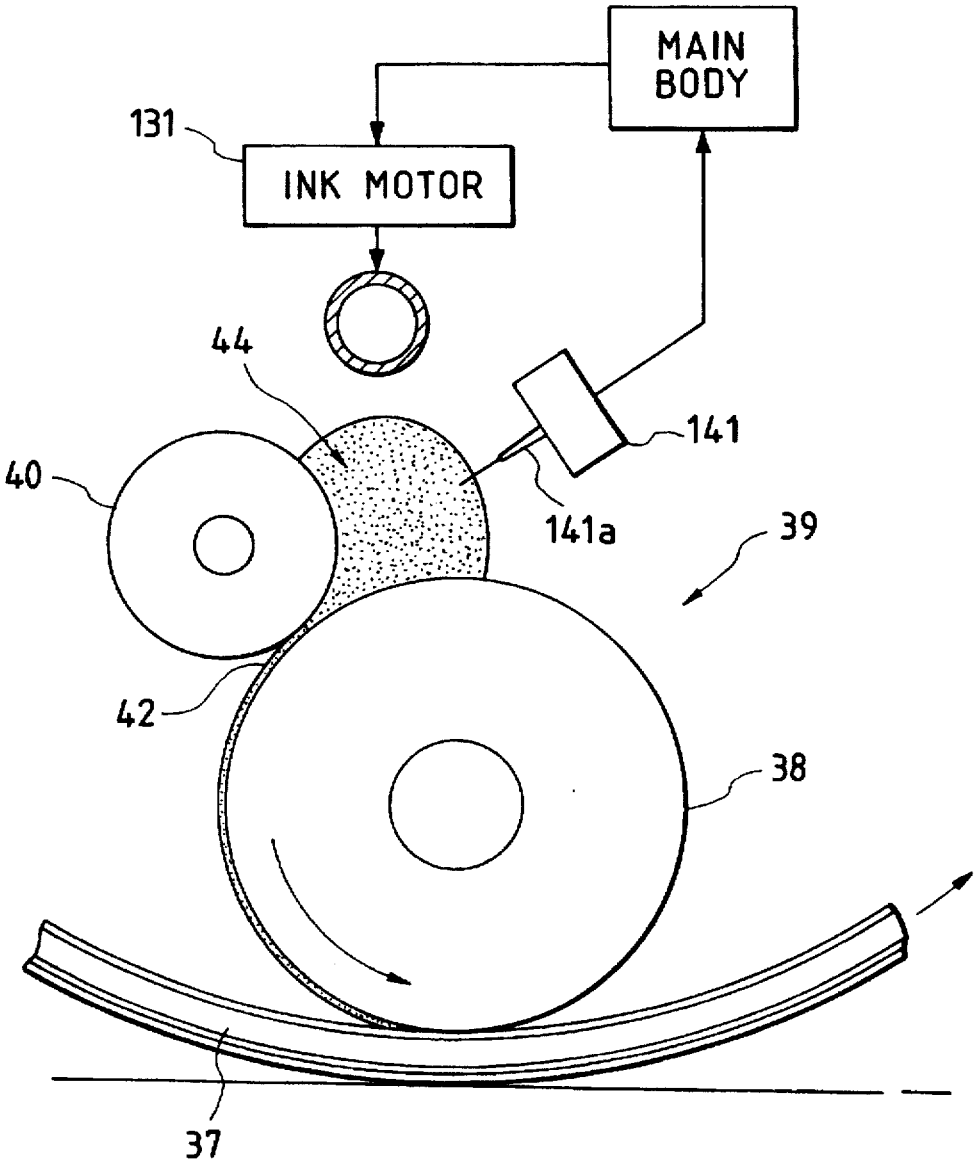
FIG. 3 is an explanatory diagram outlining the arrangement of a quantity-of-ink detecting device in stencil printing machine.

The supporting frame 122 fixedly supports the doctor roller 40 obliquely above the squeegee roller 38. The doctor roller 40 is arranged substantially in parallel with the axis of the squeegee roller 38 with a predetermined gap 42 (FIG. 3) between those rollers. On one side of the gap 42, the doctor roller 40 and the squeegee roller 38 form a wedge-shaped ink pool section 44 which is opened upwardly. The ink in the ink pool section 44 is uniformly supplied to the outer cylindrical surface of the squeegee roller 38. In the case where the ink in an ink bottle 127 is used up, the ink is supplied from the ink pool section to the printing stencil M continuously until a quantity-of-ink detecting device 141 (described later) detects the absence of ink in the ink bottle 127.

The supporting frame 122 supports the cylinder type ink bottle 127 containing ink in such a manner that the ink bottle 127 is replaceable with another one. The ink bottle 127 has an ink take-out outlet at its one end. The ink take-out outlet is detachably engaged with the ink suction inlet of an ink supplying pump 129 which is supported on the supporting frame 122. The ink bottle 127 may be an ink storing container such as a bag-in carton.

The ink supplying pumper 129 is selectively driven by an ink-supplying-pump driving motor 131 (hereinafter referred to as "an ink motor 131", when applicable) which is also mounted on the supporting frame 122. The ink supplying pump 129 has an ink discharging outlet to which ink supplying pipes 134 and 136 are connected. The ink supplying pipes 134 and 136 extend in parallel with the axis of the squeeze roller 38, so that the ink from the ink supplying pump 129 is supplied through a plurality of ink supplying outlets to the ink pool section 44.

A structure for replacing the drum 37 has been disclosed by Japanese Patent Publication No's Sho. 62-28758 and Hei. 4-46236.

An electrostatic capacity type quantity-of-ink detecting device 141 (hereinafter referred to as "an ink sensor 141", when applicable) is mounted on the supporting frame 122. The ink sensor 141 has a needle-like detecting electrode **141*a* which extends downwardly towards the ink pool section. The ink sensor 141 electrically detects the quantity of ink in the ink pool section on the basis of the fact that the electrostatic capacity between the detecting electrode 141*a* and the combination of the squeegee roller 38 and the doctor roller 40 which are confronted with the detecting electrode changes with the quantity of ink in the ink pool section 44**.

The ink sensor 141 operates as follows: When the quantity of ink in the ink pool section 44 is more than a predetermined value, the detecting electrode **141*a* is brought into contact with the ink in the ink pool section 44, as a result of which the ink sensor 141 outputs an "on" signal. On the other hand, when the quantity of ink in the ink pool section 44 is not more than the predetermined value, the detecting electrode 141a is not brought into contact with the ink in the ink pool section 44 (being spaced from the ink), so that the ink sensor 141** outputs an "off" signal.

For more information on the ink sensor, it is requested to refer to Japanese Patent Application Laid-open No. Sho. 61-198064 and Japanese Utility Model Publication No. Hei. 3-28342.

In the above-described stencil printing machine, the ink is impregnated in the porous structure of the drum 37, and therefore ink colors are limited, and a rotary cylindrical drum 37 is provided for each color; for instance, drums 37 are provided for black ink, blue ink, and red ink, respectively.

As shown in FIG. 2, on the supporting board 121, dip switches 133 and 135 are mounted which are turned on and off according to the kind of a rotary cylindrical drum 37 to be used and the kind of an ink bottle 127 loaded in the drum. The dip switches 133 and 135 form kind-of-ink detecting means which detects drum data such as the kind of an ink bottle 127 and the color of an ink from the combinations of the "on" and "off" operations of them. In the case of FIG. 2, drum data are obtained in four modes from the on and off states of those switches. That is, ink colors are assigned to the four modes, respectively; for instance, when both of the dip switches 133 and 135 are turned off, a black ink is used; and when the dip switch 133 is turned off and the dip switch 135 is turned on, a red ink is used.

In addition, drum data may be set according to the components of inks different in composition, property, and content ratio.

On the supporting board 121, an electrical connector 139 is mounted which is automatically connected to an electrical connector on the stencil printing machine body when the drum 37 is loaded in the latter. In response to the connection of those connectors, the on-off data of the dip switches 133 and 135, and the on-off data of the ink sensor 141 are transmitted to a control unit in the stencil printing machine.

The control unit is to generally control all the operations of the stencil printing machine including the operation of the ink motor 131. The control unit is a single chip microcomputer which, as shown in FIG. 4, comprises: a CPU 201 made up of a microprocessor; a ROM 203 which stores plural pieces of ink motor operation time data (that is, the time data which is long enough to determine whether or not the ink in the ink bottle 127 has been used up, and is short enough to achieve the printing operation with the ink remaining in the ink pool section 44) for every ink to be used, such as the kinds of rotary cylindrical drums 37 and the kinds of ink bottles 127 coupled to the drums 37; and a RAM 205 which, when necessary, rewrites and stores latest "no-ink" integration time data for every ink to be used (that is, integration time data for the period of time that the ink motor 132 is driven continuously according to the "on" data which is outputted in the previous printing operation, and which stores the results of operation of the microprocessor and other various input data when necessary.

In the RAM 205, the data are kept stored at all time with the aid of a battery 207; that is, they are kept stored as effective data even if the power switch of the stencil printing machine body is turned off. The RAM 205, which is backed up by the battery 207, may be provided on the drum 37.

Figure 4:
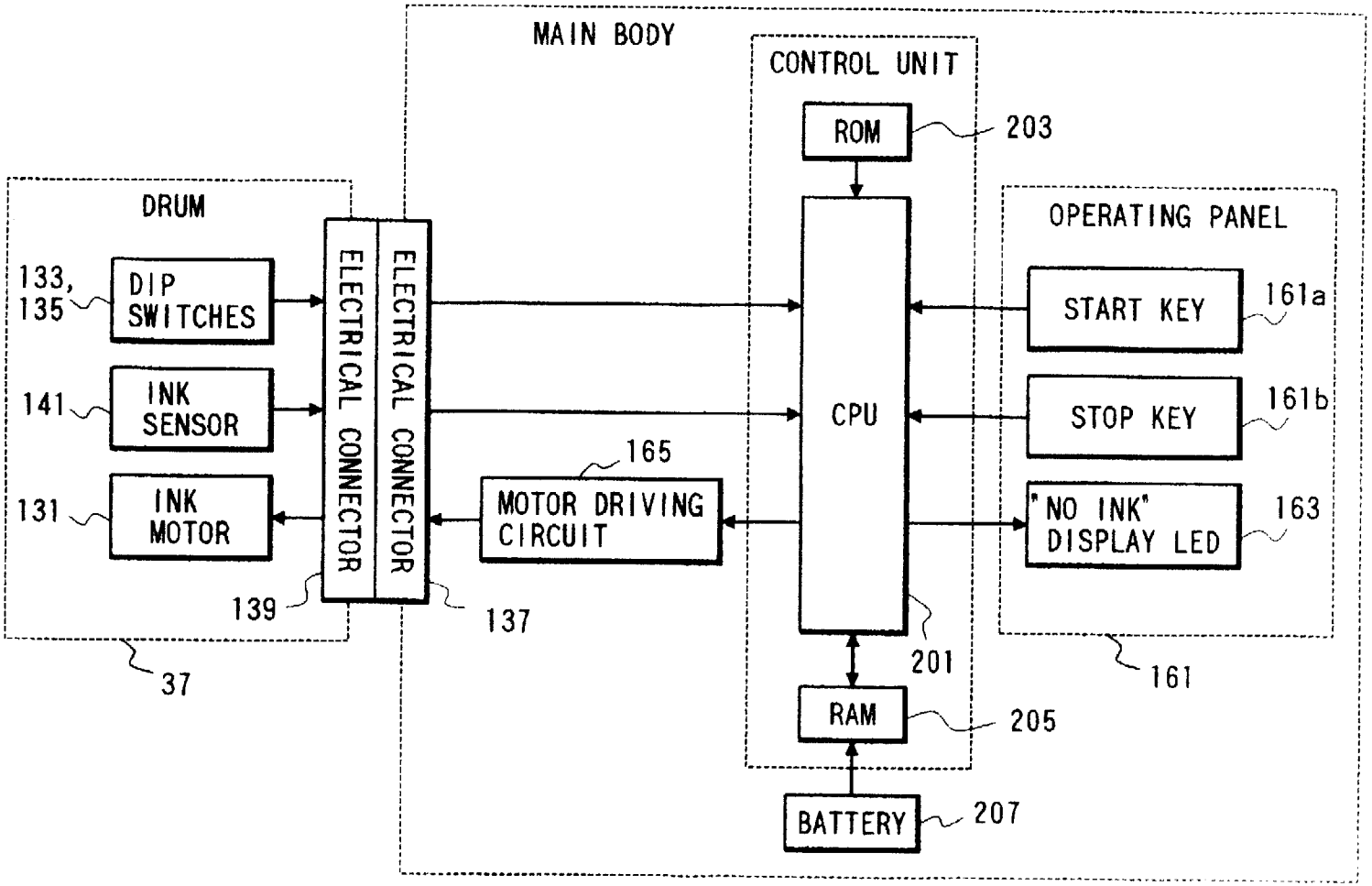
FIG. 4 is a block diagram showing a control unit in the stencil printing machine shown in FIG. 2.

For simplification in description, FIG. 4 shows only elements concerning the above-described stencil printing machine. The CPU 201 receives key data from a start key **161*a* and a stop key 161*b* which are provided on an operating panel 161, and the on-off data from an ink sensor 141, and the on-off data (for instance the color data of an ink to be used for the drum 37 set in the printing machine body) from the dip switches 133 and 135. The CPU 201 has a counter which, upon reception of the "off" data from the ink sensor 141, starts counting clock signals provided by an internal clock signal generating circuit. The count value of the counter is renewed and stored in the RAM 205 whenever an interrupt (described later) occurs. Ink motor operation times TB are stored in the ROM 203** as counter values corresponding to the kinds of ink.

The CPU 201 decides the ink motor operation time TB according to data applied thereto which is most suitable for the determination of the fact that no ink is left in an ink bottle 127 to be used, to apply a drive signal to a motor driving circuit 165 according to a control flow (described later), thereby to control the on-off operation of the ink motor 131. When the CPU 201 determines that no ink is left in the ink bottle 127, it operates to turn on an "no ink" display LED 163, thereby to indicate that the ink bottle 127 should be replaced with another one.

Figure 5:
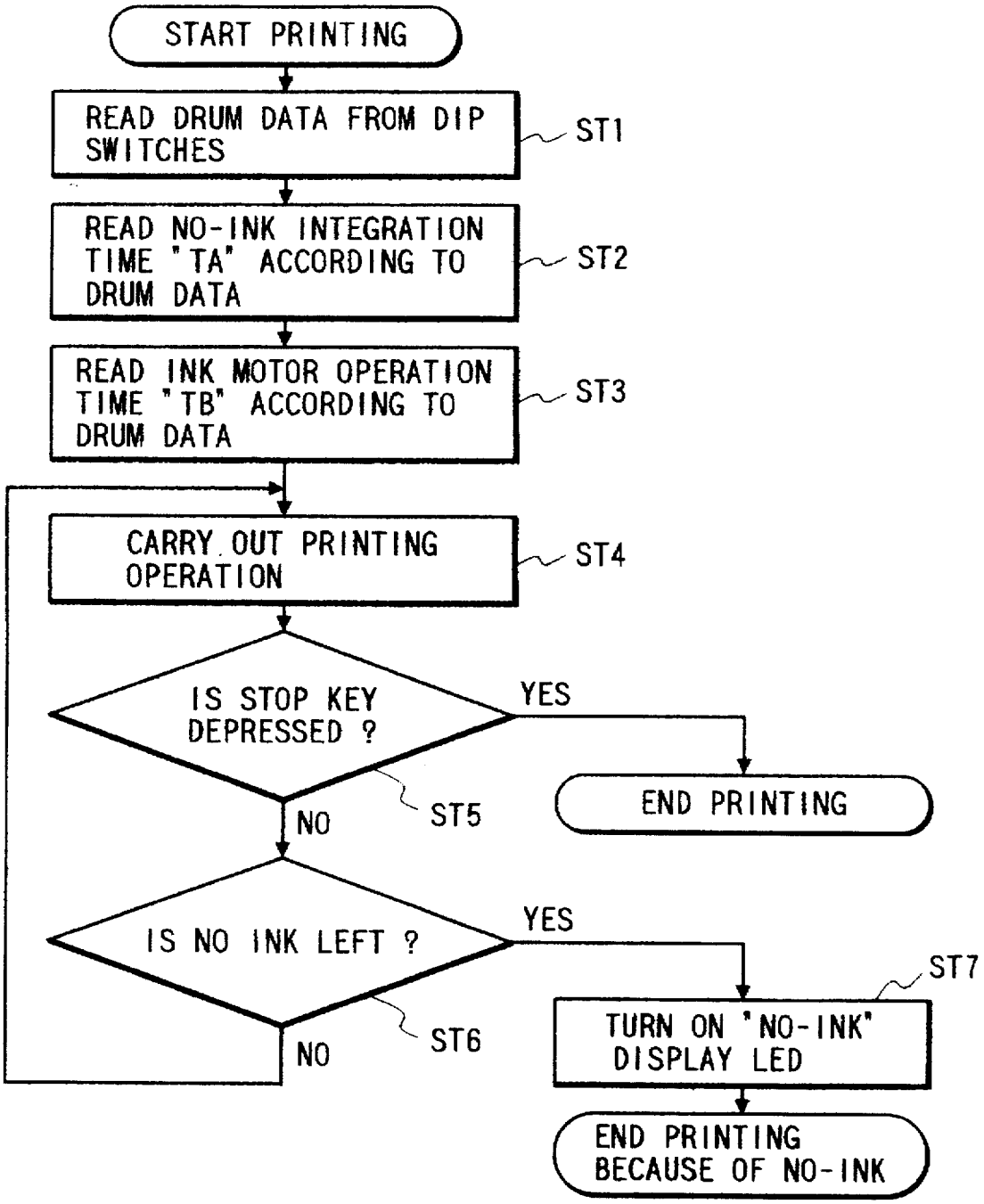
FIG. 5 is a flow chart for a description of an ink-complementing-means operation-time changing operation which is carried out by the control unit shown in FIG. 4.

FIG. 5 is a flow chart for a description of an ink-motor-operation-time changing operation in the above-described stencil printing machine. As indicated in the flow chart, when a printing operation is started by operating (depressing) the start key 161*a* on the operating panel 161, the CPU reads drum data corresponding, for instance, to an ink color from the on-off states of the dip switches 133 and 135 (Step ST1).

Next, the CPU 201 utilizes the drum data thus read, to read from the RAM 205 an no-ink integration time TA which was detected when the drum 37 was used last time (Step ST2). In addition, the CPU 201 utilizes the drum data to read from the ROM 203 an ink motor operation time TB which is most suitable for the drum 37 (Step ST3). Thereafter, a printing operation is actually carried out for instance by moving the press roller 41 (Step ST4).

When, during the printing operation, the stop key 161*b* on the operating panel 161 is depressed (Step ST5—YES) or an error occurs, or the number of prints reaches a predetermined value, the printing operation is ended. In the case where the stop key 161*b* is not depressed (Step ST5—NO), and no error occurs, and the number of prints does not reach the predetermined value yet, the printing operation is continued. When, during the printing operation, it is determined that no ink is left in the ink bottle 127 (Step ST6—YES), the "no ink" display LED 163 on the operating panel 161 is turned on (Step ST7) to indicate that the ink bottle 127 should be replaced with another one. In response to the indication, the replacement of ink bottle 127 is carried out.

When it is not determined that no ink is left in the ink bottle 127 (Step ST6—NO), the printing operation is continued since the ink still remains in the ink bottle 127 (that is, Step ST4 is effected again).

Figure 6:
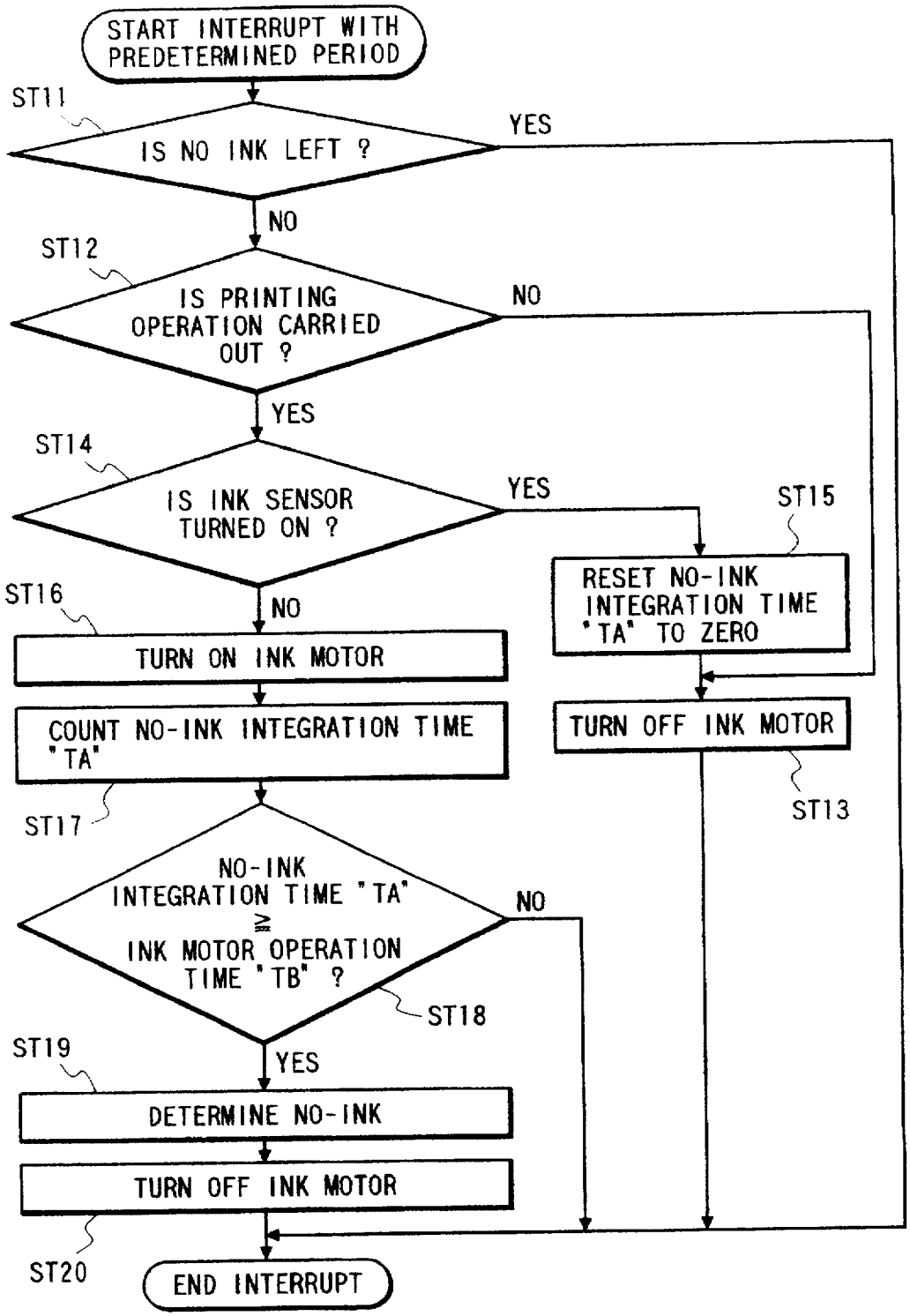
FIG. 6 is a flow chart for a description of an interrupt which occurs in parallel with the operation shown in the flow chart of FIG. 6.

As shown in FIG. 6 an interrupt is carried out with a predetermined period irrespective whether the printing operation is carried or stopped. First, when a "no ink phenomenon" occurs (no ink is left in the ink bottle) (Step ST11—YES), the interrupt is ended.

If the "no ink phenomenon" does not occur yet (Step ST11—NO), and no printing operation is carried out (Step ST12—NO), then the "off" signal is applied to the ink motor 131 to stop it (Step ST13), and the interrupt is ended. If the "no ink phenomenon" does not occur yet (Step ST11—NO), and the printing operation is carried out (Step ST12—YES), and the ink sensor 141 is turned on with the end of the detecting electrode 141a of the ink sensor 141 in contact with the ink in the ink pool section 44 (Step ST14—YES), the no-ink integration time TA in the RAM 205 is cleared (reset to zero) (Step ST15). Thereafter, the "off" signal is applied to the ink motor 131 to stop it (Step ST13), so that the supplying of ink to the ink pool section 44 is suspended.

If, in the Step ST14, the ink sensor is in the "off" state with the end of the detecting needle 141*a* spaced from the ink in the ink pool section 44 (Step ST14—NO), the "on" signal is applied to the ink motor 131 (Step ST16), so that the ink is supplied to the ink pool section 44. In this case, the no-ink integration time TA is increased by one unitary value every time (Step ST17). When the no-ink integration time TA exceeds the predetermined ink motor operation time TB in the ROM 203 (Step ST18—YES), it is determined that the ink in the ink bottle 127 is used up; that is, no ink is left in the latter 127 (Step ST19), and the ink motor 132 is stopped (Step ST 20). Hence, the supplying of ink to the ink pool section 44 is suspended. If the no-ink integration time TA does not exceed the ink motor operation time TB in the ROM 203 (Step ST18—NO), the interrupt is ended.

In the stencil printing machine organized as described above, the on-off states of the dip switches 133 and 135 of the rotary cylindrical drum 37 are determined separately according, for instance, to the different colors of inks to be used for the drums. Hence, when, in order to change the printing color, in place of the present drum 37, another one (new drum) is loaded in the stencil printing machine body, the CPU 201 detects the on-off states of the dip switches 133 and 135 of the new drum 37 loaded in the stencil printing machine body, to identify the ink color, so that an ink motor operation time TB most suitable for the ink color of the new drum 37 is automatically selected.

Hence, even when the consumption of ink is great, the stencil printing machine of the invention is free from difficulties that the ink in the ink pool section is used up before the lapse of the ink motor operation time TB as in the case of the conventional stencil printing machine, and the resultant print appears blurred. Furthermore, with the stencil printing machine of the invention, most suitable ink motor operation times TB are provided separately according to the kinds of inks. Therefore, even in the case where an ink low in viscosity is used, an ink vortex is formed in the ink in the ink pool section which is so large in diameter that the ink may not be caused to flow over the part of the outer cylindrical surface of the squeegee roller 38 which is on the lag side as viewed in the direction of rotation of the latter, thus dripping onto the inner cylindrical surface of the rotary cylindrical drum 37. Therefore, even in the case when the drum 37 is turned again to start a printing operation, the stencil printing machines is free from the difficulty accompanying the conventional one that the ink stains the inside of the drum while sticking onto the electrical circuit board forming the quantity-of-ink detecting device, the driving mechanism, etc., thus adversely affecting the operation of the stencil printing machine. Hence, the resultant print is uniform in density.

In the above-described printing machine, the ink motor operation time TB is compared with the no-ink integration time TA which was detected when the drum was used for printing last time. And the on-off control of the ink motor 131 is made according to the result of the comparison. Hence, where the no-ink integration time TA exceeds the ink motor operation time TB, it is determined that the ink in the ink bottle 127 is completely used up, so that the ink motor 131 is immediately stopped. Therefore, the load applied to the ink motor 131 is lessened as much, and the latter 131 is protected from damage such as for instance seizure. In this case, the printing operation is suspended, while the no-ink display LED 163 is turned on, thus indicates the requirement that, irrespective of the kind of the ink, the ink bottle 127 should be replaced with another one before the ink in the ink pool section is used up.

In the above-described stencil printing machine, the combinations of the "on" and "off" states of the two dip switches provide the four modes, or four different rotary cylindrical drums. Modes for more than four different rotary cylindrical drums may be obtained by increasing the number of dip switches. In the above-described embodiment, the kind-of-ink detecting means for obtaining drum data comprises the dip switches 133 and 135; however, the invention is not limited thereto or thereby. That is, it may be formed as shown in FIGS. 7, 8 and 9.

Figure 7:
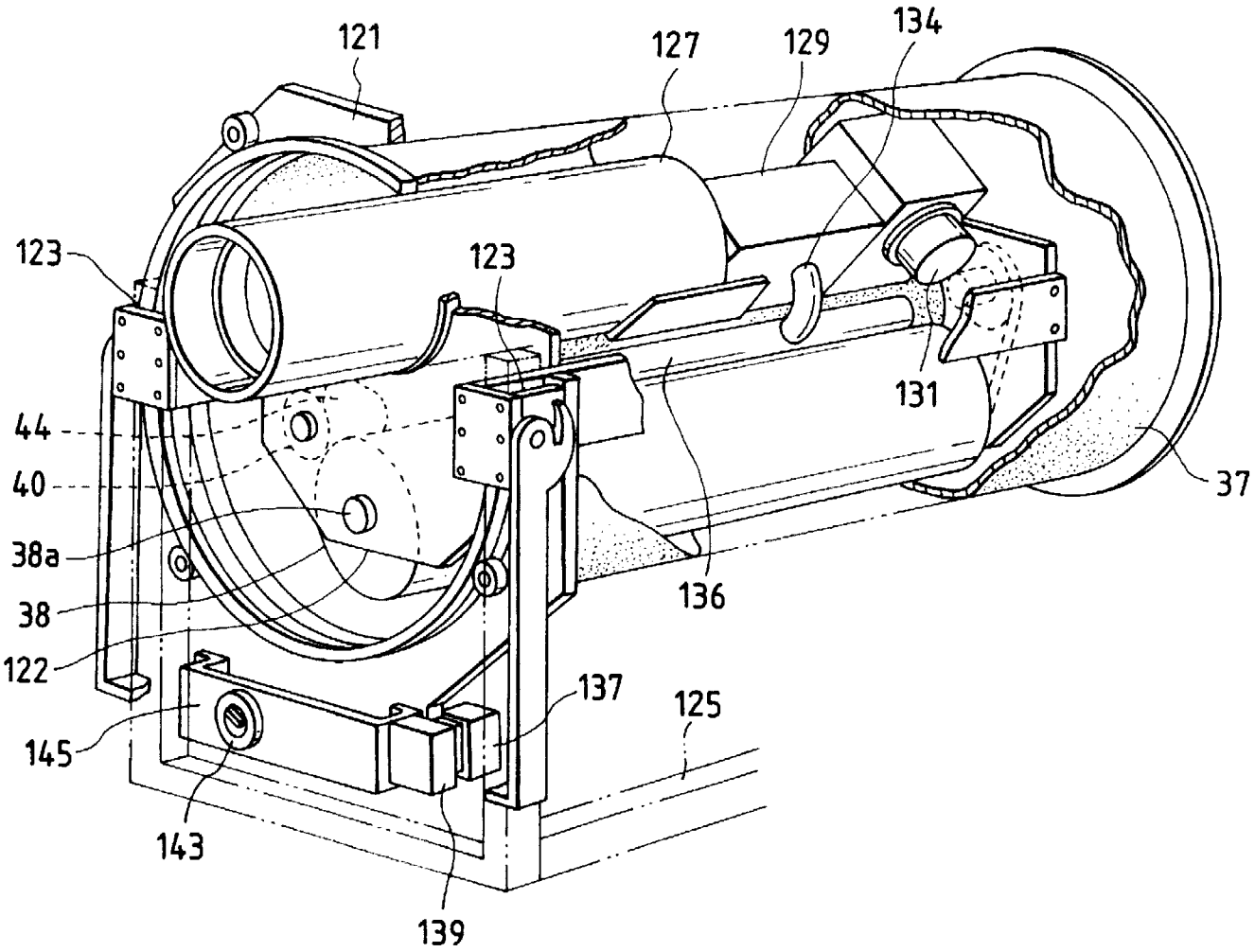
FIG. 7 is a perspective view, with parts cut away, showing a first modification of kind-of-ink detecting means shown in FIG. 2 which is arranged in the rotary cylindrical drum in the stencil printing machine.

A kind-of-ink detecting means shown in FIG. 7 uses a rotary switch 143. The switch 143 is mounted on a U-shaped board member 145 which is fixedly mounted on the supporting board 121 and is used as a handle for pulling out the rotary cylindrical drum. In the rotary switch 143, different drum data are assigned to different contacts arranged linearly or circumferentially, respectively.

Figure 8:
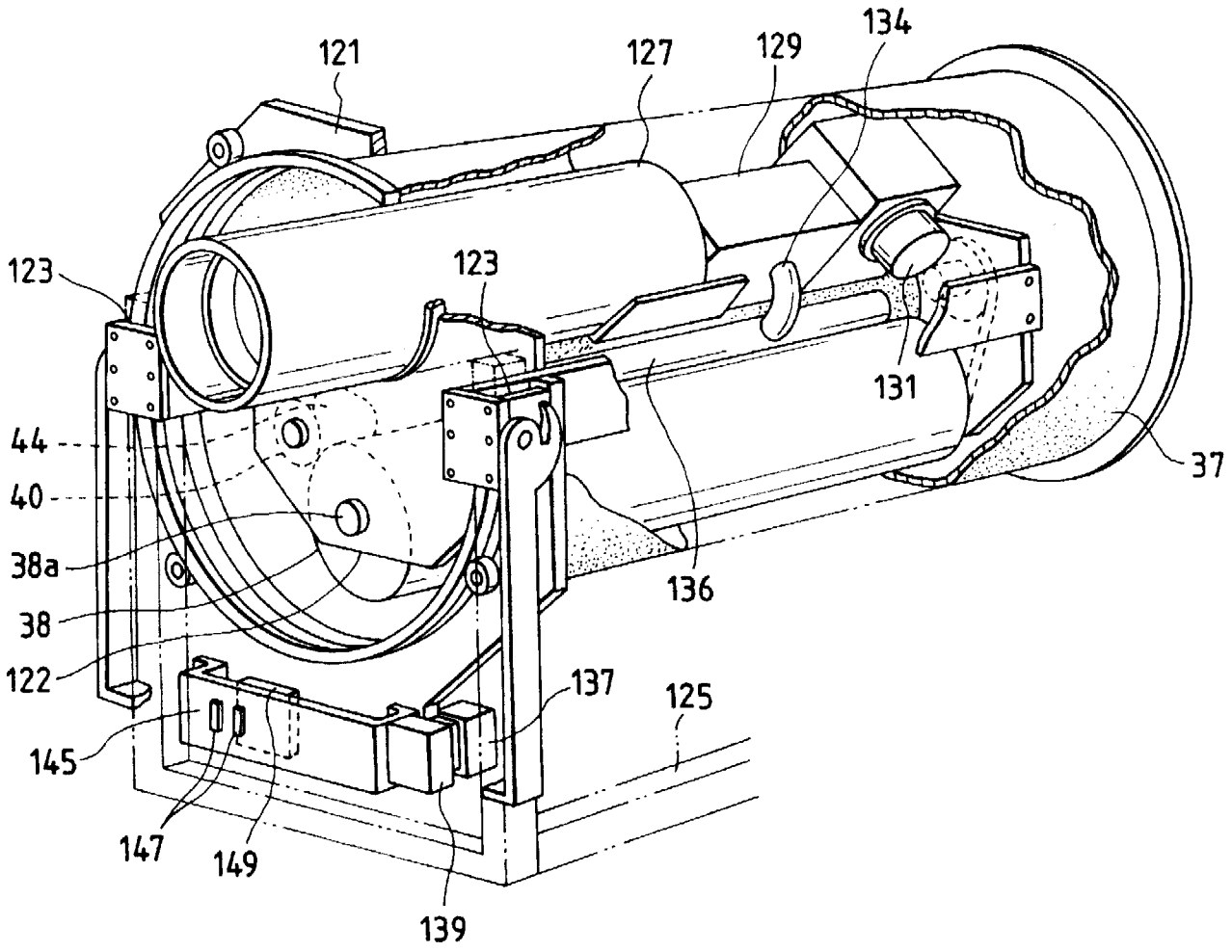
FIG. 8 is a perspective view, with parts cut away, showing a second modification of kind-of-ink detecting means shown in FIG. 2 which is arranged in the rotary cylindrical drum in the stencil printing machine.

A kind-of-ink detecting means shown in FIG. 8 uses slits 147 and an optical sensor 149. The slits 47 are formed in the board member 145. The slits 47 are variously spaced as viewed in the widthwise direction of the board member 145 to identify different drum data. The optical sensor 149 is provided on the side of the printing machine body in such a manner that it is confronted with the slits 147. The optical sensor 149 detects the presence or absence of the slits 147 to output detection signals, which are applied to the control unit. Instead of the slits 147, pieces of reflecting tape may be employed.

Figure 9:
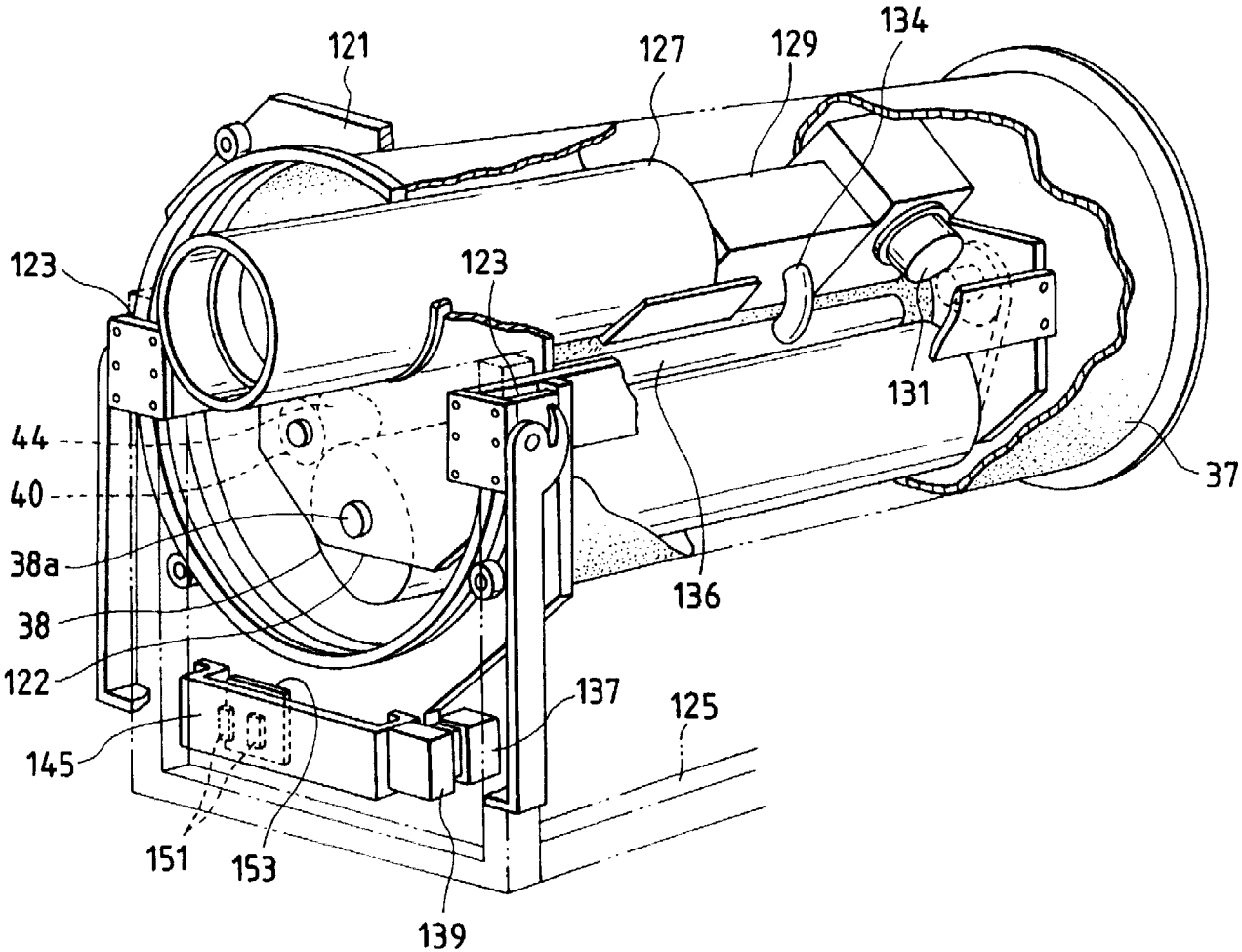
FIG. 9 is a perspective view, with parts cut away, showing a third modification of kind-of-ink detecting means shown in FIG. 2 which is arranged in the rotary cylindrical drum in the stencil printing machine.

A kind-of-ink detecting means shown in FIG. 9 is made up of magnetic pieces 151 and a magnetic sensor 153. The magnetic pieces 151 are mounted on the board member 145. The magnetic pieces 151 are changed in position in the widthwise direction of the board member 145 separately according to different drum data. The magnetic sensor 153 is arranged on the side of the printing machine body in such a manner that they are confronted with the magnetic pieces 151. The magnetic sensor 153 detects the presence or absence of the magnetic pieces to output detections signals which are applied to the control unit.

Second Example of the Replaceable Drum

Figure 10:
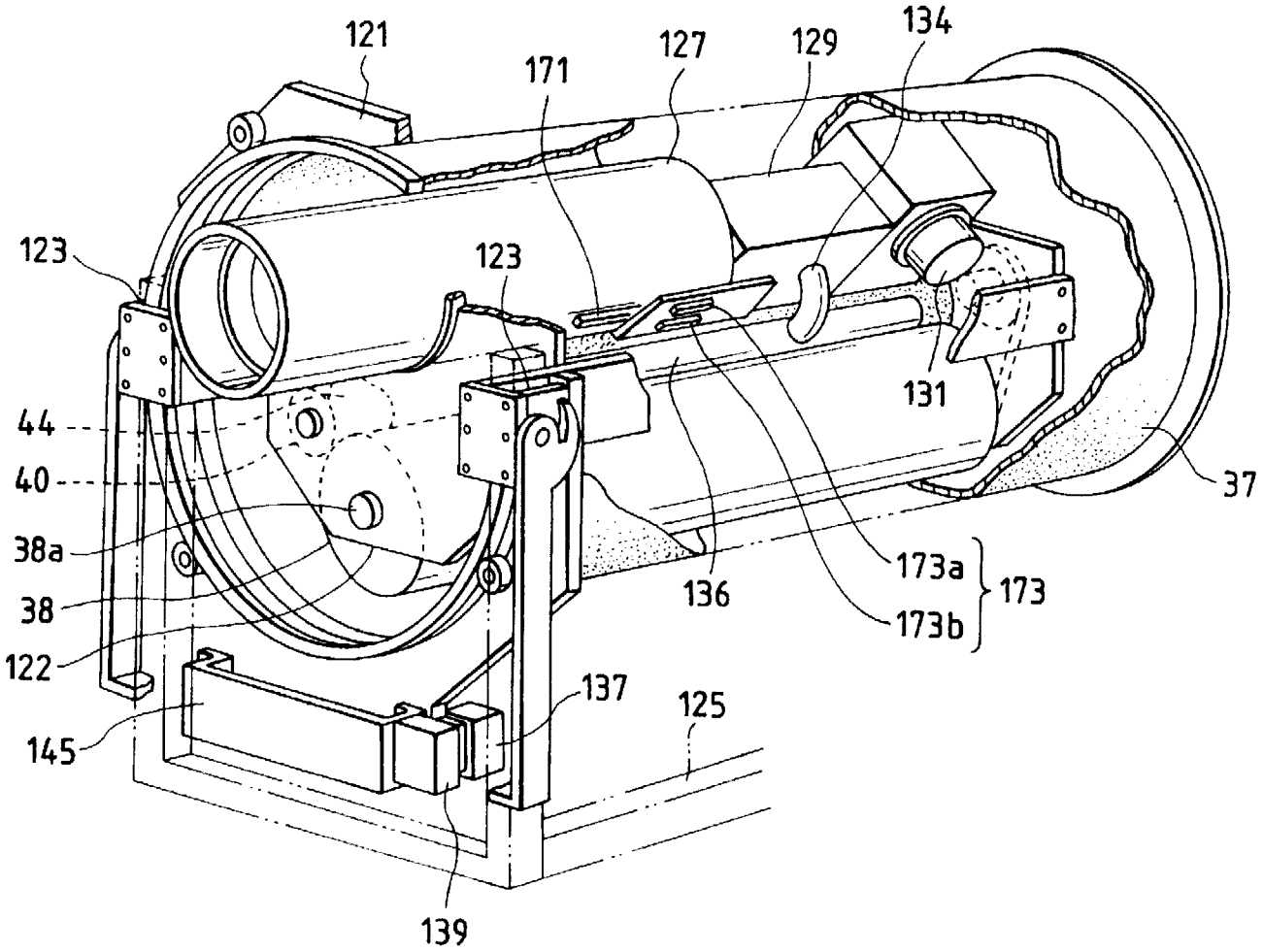
FIG. 10 is a perspective view showing a second example of the replaceable rotary cylindrical drum in the stencil printing machine.

FIG. 10 is a perspective view showing a second example of the replaceable rotary cylindrical drum employed in the stencil printing machine according to the invention. In FIG. 2, parts corresponding functionally to those already described with reference to the first example of the replaceable rotary cylindrical drum shown in FIG. 2 are therefore designated by the same reference numerals or characters.

In the second example of the replaceable rotary cylindrical drum 37, instead of the drum-data setting dip switches 133 and 135 shown in FIG. 2 the following means is provided: That is, a rectangular-prism-shaped rib 171 is arranged on the outer cylindrical surface of the ink bottle 127. The presence or absence of the rib 171 represents the kind of ink in the ink bottle 127. Plural different ink bottle data are provided according to whether or not the ribs 171 are formed on the outer cylindrical surface of the ink bottle 127 at predetermined intervals as viewed in the circumferential direction.

An ink bottle switch 173 (representing an ink bottle switch **173*a* and/or an ink bottle switch 173*b* as described later) for detecting the presence or absence of the rib 171 is mounted on the supporting frame 122. In the case when the ink bottle is loaded into the drum 37 with the rib 17 at a predetermined position, the ink bottle switch means 173** is turned on or off to output an "on" or "off" signal, which is applied to the control unit.

In the case of FIG. 10, two ink bottle switches **173*a* and 173*b* are provided. Hence, depending on the presence or absence of the rib for each of the switches 173*a* and 173*b*, four modes are set up, to which four different ink colors are assigned, respectively. More specifically, in the case of FIG. 10, the rib 171 is provided for only one 173*b*** of the two ink bottle switches. In the case where given inks are equivalent in property to each other although they are different in color, those inks may be assigned to one and the same mode.

Figure 11:
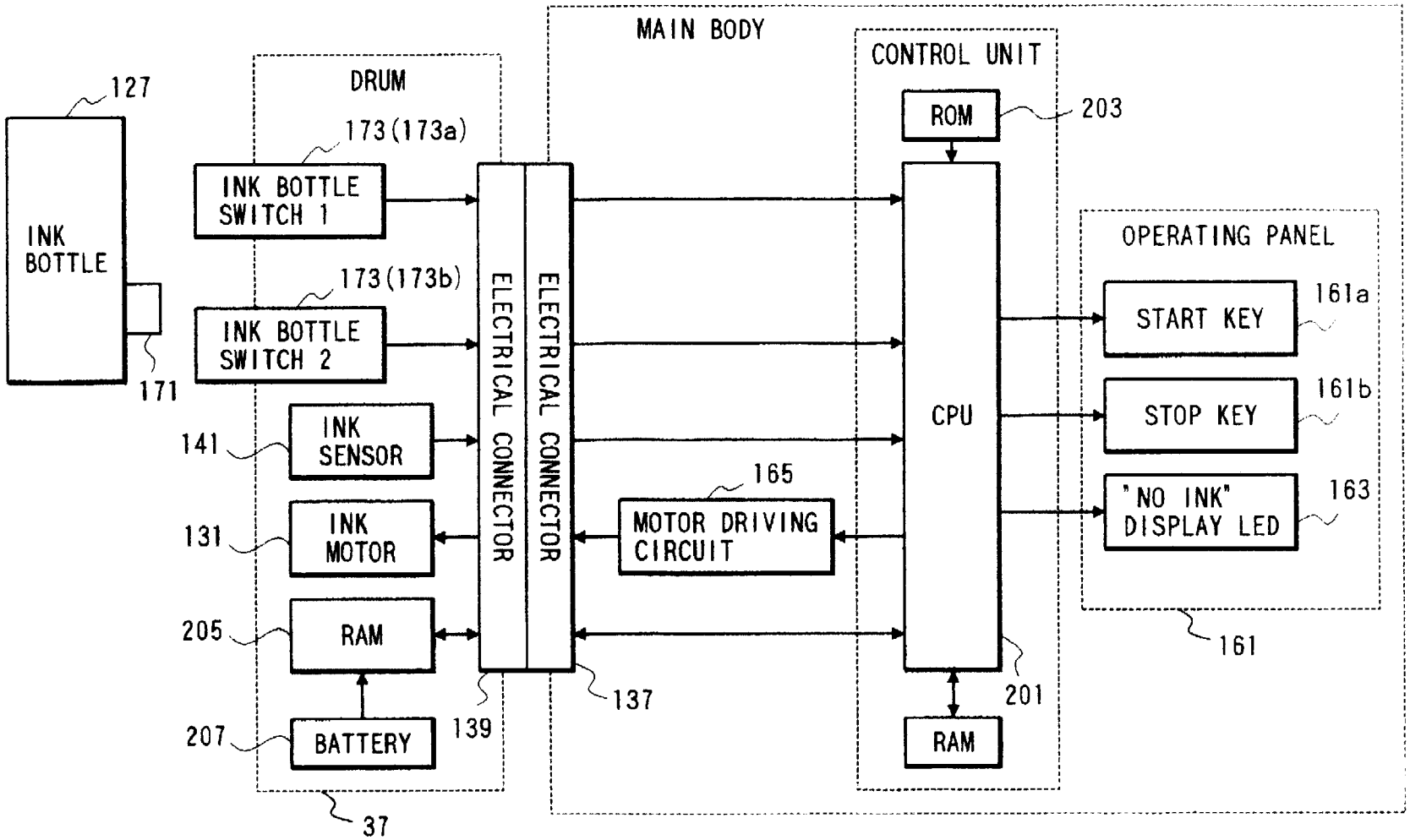
FIG. 11 is a block diagram for a description of the operation of a control unit in the stencil printing machine shown in FIG. 10.

FIG. 11 is a block diagram showing the arrangement of a control unit in the stencil printing machine which employs the replaceable rotary cylindrical drum mentioned above.

The control unit shown in FIG. 11 is different from the one shown in FIG. 4 in the following points: The ink bottle switch 173 outputting the "on" or "off" data depending on the presence or absence of the rib 171 is connected to the electrical connector 139. In addition to the RAM which stores the results of calculation performed by the microprocessor and other input data when required, a RAM 205 which has stored "no ink" integration times is provided. The RAM 205 is connected to the electrical connector 139 while being backed up by a battery 207, when the ink bottle is loaded into the drum 37.

Figure 12:
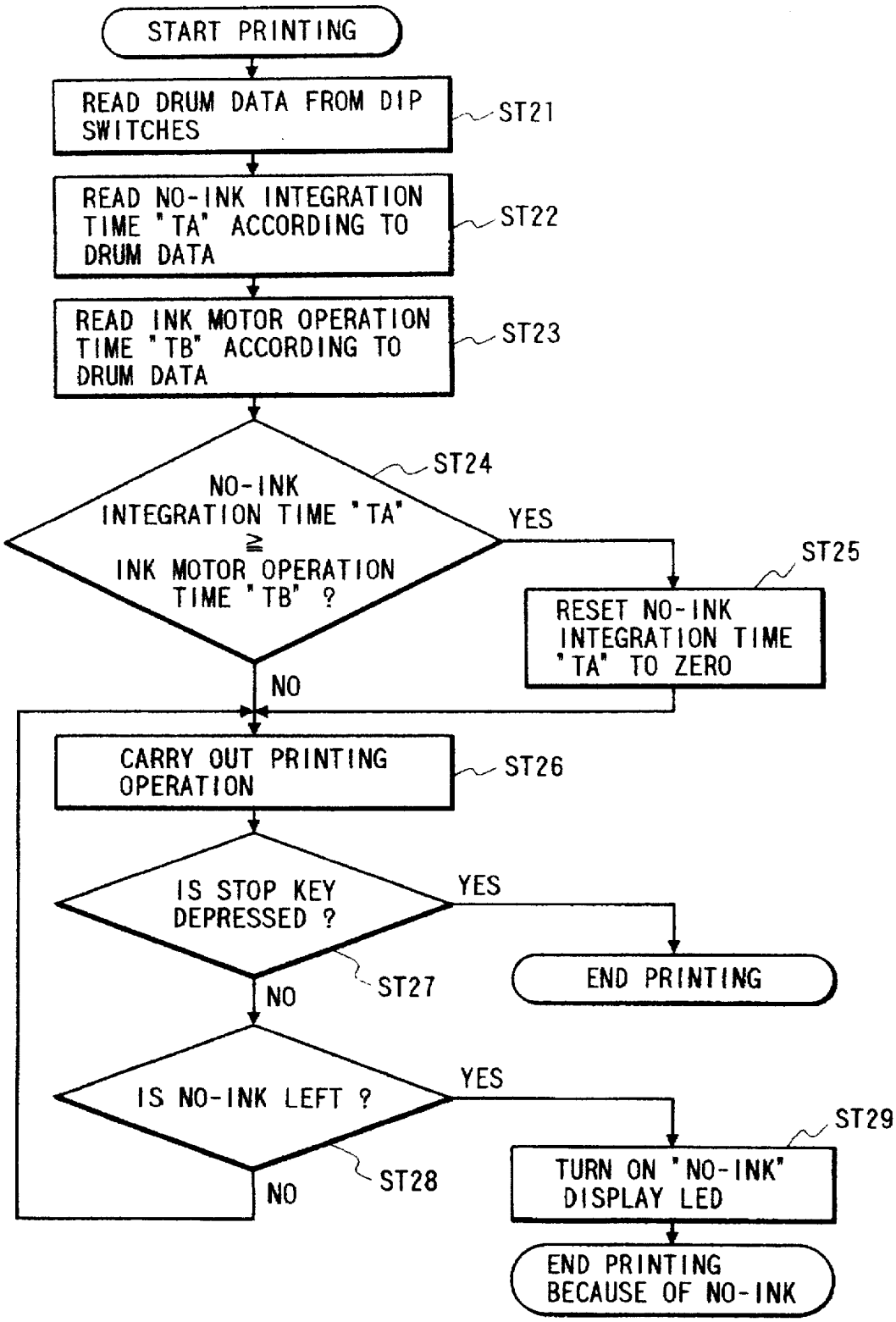
FIG. 12 is a flow chart for a description of an ink-complementing-means operation-time changing operation which is carried out by the control unit shown in FIG. 11.

FIG. 12 is a flow chart for a description of an ink-motor-operation-time changing operation in the above-described stencil printing machine. When the machine becomes ready for starting a printing operation, for instance, with the drum 37 replaced with another one and with the machine body cover closed, the CPU 201 reads ink bottle data corresponding to the ink color with the aid of the rib or ribs 171 formed on the ink bottle 127 and the ink bottle switch 173 (representing the ink bottle switch **173*a* and/or the ink bottle switch 173*b***) (Step ST21).

Next, the CPU 201, according to the ink bottle data thus read, reads the "no-ink" integration time TA from the RAM 205 in the drum 37 which was obtained when the drum 37 with the ink bottle was used last time (Step ST22). In addition, the CPU, according to the ink bottle data, reads from the ROM 203 an ink motor operation time TB suitable for the drum 37 (ST 23).

In the case where the "no ink" integration time TA is equal to or longer than the ink motor operation time TB (Step ST24—YES), it is determined that an ink bottle 127 different in ink from the previous one has been loaded in the drum 37, and the "no ink" integration time TA read from the RAM 205 is cleared (Step ST25). When the "no ink" integration time TA is shorter than the ink motor operation time TB (Step ST24—NO), the "no ink" integration time TA thus read is used as it is. When, under this condition, the start key **161*a* on the operating panel 161** is depressed, a printing operation is actually carried out (Step ST26).

When, during the printing operation, the stop key **161*b* on the operating panel 161 is depressed (Step ST27—YES), or an error occurs, or the number of prints reaches a predetermined value, the printing operation is ended. If the stop key 161*b* is not depressed (Step ST27—NO), or no error occurs, or the number of prints does not reach the predetermined value yet, the printing operation is continued. And when, during the printing operation, it is determined that no ink is left in the ink bottle 127 (Step ST28—YES), the "no ink" display LED 163 on the operating panel 161 is turned on (Step ST29), thus requesting the replacement of the ink bottle 127**.

If it is not determined that no ink is left in the ink bottle 127 (Step ST28—NO), the printing operation is continued (that is, returning to ST 26).

No matter which the printing operation is carried or stopped, the interrupt shown in FIG. 6 occurs with a predetermined period.

In the above-described stencil printing machine, the kind-of-ink detecting means comprises the rib or ribs 171 protruding from the ink bottle 127, and the ink bottle switch 173 mounted on the drum 37, to set up four different modes. More than four modes may be obtained by increasing the number of ribs 171 and that of the ink bottle switches 173. The rib or ribs protruding from the ink bottle 127 may be replaced with a recess or recesses which are formed in the ink bottle 127. In this case, each ink bottle switch 173 is turned on and off depending on the presence or absence of the respective recess. The above-described kind-of-ink detecting means for obtaining ink bottle data comprises the rib or ribs 171 and the ink bottle switch 173; however, the invention is not limited thereto or thereby. That is, it may be modified as shown in FIG. 13.

Figure 13:
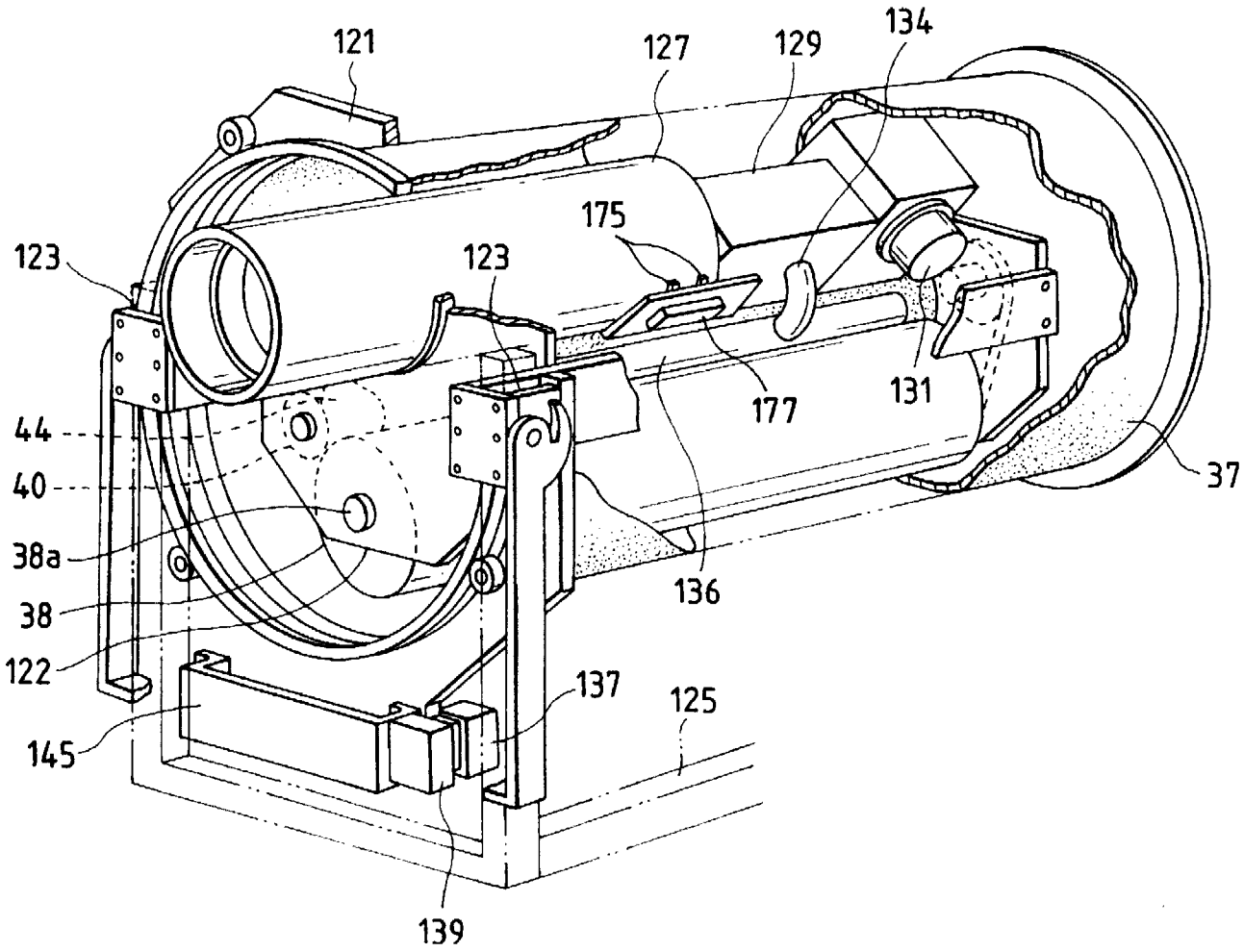
FIG. 13 is a perspective view, with parts cut away, showing one modification of kind-of-ink detecting means provided for an ink bottle in the stencil printing machine shown in FIG. 10.

The kind-of-ink detecting means shown in FIG. 13, comprises reflecting pieces 175, and an optical sensor 177. The reflecting pieces 175 have optical data such as bar codes and character identifying data as ink bottle data. The optical sensor 177 is mounted on the supporting frame 122 so as to confront with the reflecting piece. The sensor 177 detects ink bottle data from the presence or absence of each of the reflecting pieces 175, to output a detection signal, which is applied to the control unit. The kind-of-ink detecting means may be replaced with the one which comprises magnetic pieces and a magnetic sensor (not shown).

In the above-described embodiment, the ink bottle data are provided for ink colors; however, the invention is not limited thereto or thereby. That is, the ink bottle data may be determined separately according to the data concerning ink viscosity, for instance composition, property, and content ratio.

When, in the stencil printing machine, the rotary cylindrical drum having the ink bottle is replaced with another one before a printing operation starts, the ink data provided on the new drum or ink bottle is detected so that the kind of the ink in the ink bottle is read. Thus, for each of the rotary cylindrical drums different in the kind of ink, the ink-complementing-means operation time can be set to a most suitable value.

Accordingly, the stencil printing machine is free from the difficulty accompanying conventional stencil printing machine that the ink in the ink pool section is used up before the lapse of the ink-complementing-mean operation time, so that the resultant ink appears blurred (unclear). Furthermore, the ink-complementing-means operation time is set to the value most suitable for the kind of ink to be used. Hence, the resultant print is uniform in density.

When the period of time which elapses from the time instant that the quantity-of-ink detecting means outputs the signal indicating that the quantity of ink supplied to the ink supplying section is smaller than the predetermined value, becomes longer than the ink-complementing-means operating time, it is determined that no ink is left in the ink bottle, and the supplying of ink to the ink supplying section is suspended. Hence, the load is lessened which is applied to the driving system such as the motor which controls the quantity of ink supplied to the ink supplying section. Hence, the driving system is protected from damage such as for instance seizure.

What is claimed is:

1. A stencil printing machine comprising:

a machine body;

a rotary cylindrical drum having an ink supply section, said rotary cylindrical drum being accommodated in said machine body;

an ink storing container containing an ink;

ink complementing means for supplying the ink to said ink supply section such that, when the quantity of ink supplied into said ink supplying section is smaller than a predetermine value, said ink complementing means is driven to supply the ink from said ink storing container into said ink supplying section, and when the quantity of ink in said ink supplying section does not reach said predetermined value within an ink-complementing-means operation time, a determination is made that no ink is left in said ink storing container, and a warning signal is produced;

quantity-of-ink detecting means for detecting whether or not the quantity of ink in said ink supplying section has reached said predetermined value;

kind-of-ink detecting means for detecting the kind of ink supplied into said ink supplying section in said rotary cylindrical drum; and control means which operates to change, according to the kind of ink detected by said kind-of-ink detecting means, said ink-complementing-means operation time which elapses until a determination is made that no ink is left in said ink storing container.

2. The stencil printing machine according to claim 1, wherein said kind-of-ink detecting means detects the kind of ink from data regarding ink color, or from data concerning ink viscosity.

3. The stencil printing machine according to claim 1, wherein said quantity-of-ink detecting means comprises memory means for storing data of an integration time for which said ink complementing means is continuously driven according to a signal representing that the quantity of ink supplied into said ink supplying section is smaller than said predetermined value.

4. The stencil printing machine according to claim 3, wherein said control means operates to stop driving of said ink complementing means when said integration time stored in said memory means exceeds said ink-complement-means operation time.

5. The stencil printing machine according to claim 1, wherein said ink storing container is replaceably loaded in said machine body, and has ink data indicating the kind of ink contained therein, and wherein said kind-of-ink detecting means detects the kind of ink supplied into said ink supplying section in said rotary cylindrical drum according to said ink data.

6. The stencil printing machine according to claim 5, wherein said ink data include provided as optical data such as bar codes, and character identifying data, and said kind-of-ink detecting means includes an optical sensor for reading said optical data.

7. The stencil printing machine according to claim 5, further comprising a magnetic piece in which said ink data are magnetically recorded, wherein said kind-of-ink detecting means includes a magnetic sensor for reading said ink data of said magnetic piece.

8. The stencil printing machine according to claim 5, wherein said ink data are represented by a protrusion or a recess formed in said ink storing container, and said kind-of-ink detecting means includes a switch for detecting the configuration of said protrusion or said recess.

9. The stencil printing machine according to claim 1, wherein said rotary cylindrical drum is replaceably loaded in said machine body and has ink data indicating the kind of ink, and wherein said kind-of-ink detecting means detects from said ink data the kind of ink supplied into said ink supplying section in said rotary cylindrical drum.

10. The stencil printing machine according to claim 9, further comprising data giving means formed on said cylindrical drum, for giving said ink data thereto.

11. The stencil printing machine according to claim 10, wherein said data giving means comprises a plurality of dip switches or rotary switch.

12. The stencil printing machine according to claim 9, wherein said ink data include optical data such as bar codes, slits, reflecting piece, and character identifying data, and wherein said kind-of-ink detecting means comprises an optical sensor adapted to read said optical data.

13. The stencil printing machine according to claim 9, further comprising a magnetic piece on which said ink data are magnetically recorded, wherein said kind-of-ink detecting means includes a magnetic sensor for reading said ink data of said magnetic piece.

14. The stencil printing machine according to claim 1, wherein said ink supplying section comprises:

a squeegee roller for applying ink to the inner cylindrical surface of said rotary cylindrical drum;

a doctor roller arranged adjacent to said squeegee roller;

an ink distributor for distributing the ink which is supplied from said ink storing container to an ink pool section which is formed by said squeegee roller and said doctor roller.

15. The stencil printing machine according to claim 14, wherein said quantity-of-ink detecting means has a detecting electrode which contacts or leaves the ink in said ink pool section depending on the quantity of ink in said ink pool section, and wherein said quantity-of-ink detecting means detects the quantity of ink from variations in the electrostatic capacity between said detecting electrode and combination of said squeegee roller and doctor roller which are due to whether or not said detecting electrode is in contact with the ink in said ink pool section.

16. A ink-supply control device for a stencil printing machine in which, when quantity of ink supplied into an ink supplying section in a rotary cylindrical drum is smaller than a predetermine value, ink complementing means is driven to supply ink from an ink storing container into the ink supplying section, and when the quantity of ink in the ink supplying section does not reach the predetermined value within an ink-complementing-means operation time, a determination is made that no ink is left in the ink storing container, and a warning signal is produced, said ink-supply control device comprising:

quantity-of-ink detecting means for detecting whether or not the quantity of ink in the ink supplying section has reached the predetermined value;

kind-of-ink detecting means for detecting the kind of ink supplied into the ink supplying section in the rotary cylindrical drum; and control means which operates to change, according to the kind of ink detected by said kind-of-ink detecting means, the ink-complementing-means operation time which elapses until a determination is made that no ink is left in the ink storing container.

17. The ink-supply control device according to claim 16, wherein said kind-of-ink detecting means detects the kind of ink from data regarding ink color, or from data concerning ink viscosity.

18. The ink-supply control device according to claim 16, wherein said quantity-of-ink detecting means comprises:

storing means for storing data on an integration time for which the ink complementing means is continuously driven according to a signal representing that the quantity of ink supplied into the ink supplying section is smaller than said predetermined value.

19. The ink-supply control device according to claim 18, wherein said control means operates to stop driving of the ink complementing means when said integration time stored in said storing means exceeds said ink-complement-means operation time.

20. The ink-supply control device according to claim 16, further comprising ink data formed on the ink storing container, wherein said ink data indicates the kind of ink contained in the ink storing container, and wherein said kind-of-ink detecting means detects the kind of ink supplied into the ink supplying section in the rotary cylindrical drum according to said ink data.

21. The ink-supply control device according to claim 20, wherein said ink data include optical data such as bar codes, and character identifying data, and wherein said kind- of-ink detecting means includes an optical sensor for reading said optical data.

22. The ink-supply control device according to claim 20, further comprising a magnet piece on which said ink data are magnetically recorded, wherein said kind-of-ink detecting means includes a magnetic sensor for reading said ink data of said magnetic piece.

23. The ink-supply control device according to claim 20, wherein said ink data includes a protrusion or a recess formed in said ink storing container, and wherein said kind-of-ink detecting means includes a switch for detecting the configuration of said protrusion or said recess.

24. The ink-supply control device according to claim 16, further comprising ink data formed on the rotary cylindrical drum, wherein ink data indicate the kind of ink, and wherein said kind-of-ink detecting means detects from said ink data the kind of ink supplied into the ink supplying section in the rotary cylindrical drum.

25. The ink-supply control device according to claim 24, further comprising data giving means formed on the rotary cylindrical drum, for giving said ink data thereto.

26. The ink-supply control device according to claim 25, wherein said data giving means comprises a plurality of dip switches or rotary switch.

27. The ink-supply control device according to claim 24, wherein said ink data include optical data such as bar codes, slits, reflecting piece, and character identifying data, and wherein said kind-of-ink detecting means includes an optical sensor adapted to read said optical data.

28. The ink-supply control device according to claim 24, further comprising a magnet piece on which said ink data are magnetically recorded, wherein said kind-of-ink detecting means includes a magnetic sensor for reading said ink data of said magnetic piece.

* * * * *